US005279538A

United States Patent [19]

Carson

[11] Patent Number: 5,279,538

[45] Date of Patent: Jan. 18, 1994

[54] CENTRIFUGE ROTOR HAVING A PREDETERMINED REGION OF FAILURE

[75] Inventor: David M. Carson, Newtown, Conn.

[73] Assignee: E. I. Du Pont de Nemours and Company, Wilmington, Del.

[21] Appl. No.: 793,512

[22] Filed: Nov. 18, 1991

[51] Int. Cl.[5] ..... B04B 5/04

[52] U.S. Cl. ..... 494/81; 494/16; 494/82

[58] Field of Search ..... 494/81, 82, 83, 84, 494/85, 43, 16; 74/573; F416/144, 145

[56] References Cited

U.S. PATENT DOCUMENTS

| | | | |
|---|---|---|---|
| 3,101,322 | 8/1963 | Stallman et al. | 233/24 |
| 3,662,619 | 5/1972 | Seeliger | 74/572 |
| 3,990,633 | 11/1976 | Stahl et al. | 233/23 |
| 4,111,067 | 9/1978 | Hodson | 74/572 |
| 4,132,130 | 1/1979 | Schneider | 74/572 |
| 4,449,966 | 5/1984 | Piramoon | 494/22 |
| 4,477,226 | 10/1984 | Carreno | 416/144 |
| 4,507,047 | 3/1985 | Coons | 415/9 |
| 4,509,896 | 4/1985 | Linsker | 415/9 |
| 4,547,185 | 10/1985 | Hellekant | 494/82 |
| 4,568,325 | 2/1986 | Cheng et al. | 494/84 |
| 4,568,325 | 2/1986 | Cheng et al. | 494/84 |
| 4,586,918 | 5/1986 | Cole | 494/81 |
| 4,693,702 | 9/1987 | Carson et al. | 494/61 |
| 4,753,630 | 6/1988 | Romanauskas | 494/9 |
| 4,753,631 | 6/1988 | Romanauskas | 494/9 |
| 4,817,454 | 4/1989 | Schopf et al. | 74/572 |
| 4,822,330 | 4/1989 | Penhasi | 494/16 |
| 4,824,429 | 4/1989 | Keunen et al. | 494/81 |

FOREIGN PATENT DOCUMENTS 3806284 4/1989 Fed. Rep. of Germany .

*Primary Examiner*—Timothy F. Simone
*Assistant Examiner*—Reginold L. Alexander

[57] ABSTRACT

A centrifuge rotor is characterized by a portion of the undersurface thereof being removed to define a predetermined number of bosses, each with a sample receiving cavity therein. A relatively thin skirt portion extends between at least one pair of adjacent bosses. The skirt portion has defined thereon a localized region which exhibits a stress therein that is greater than the stress present in any other portion of the rotor when the rotor is operating at the predetermined operating speed. The skirt may have a weight thereon. The weight may be either separate from or formed integrally with the skirt. Additionally or alternatively, a stress riser, in the form of one or a pair of hole(s), notch(es) or groove(s), may be defining on the skirt. Over operation time, the probability that rotor failure will occur only in the localized region of the skirt is enhanced.

20 Claims, 4 Drawing Sheets

CENTRIFUGE ROTOR HAVING A PREDETERMINED REGION OF FAILURE

BACKGROUND OF THE INVENTION

1. Field of the Invention

The present invention relates to a centrifuge rotor, and in particular, to a centrifuge rotor having a predetermined localized region thereon where the occurrence of a failure due to fatigue is most probable.

2. Description of the Prior Art

A centrifuge rotor is a relatively massive member used within a centrifuge instrument to expose a liquid sample to a centrifugal force field. The rotor is provided with a plurality of cavities in which containers carrying the liquid sample are received. The rotor has a central, axial mounting recess provided therein, whereby the rotor may be mounted to a shaft extending from a source of motive energy.

The possibility exists that, in use, the rotor may break apart due either to i) fatigue failure of the rotor material, ii) the imposition of excessive centrifugally induced stresses when the rotor is rotated past its predetermined rated speed (overspeed failure), or iii) failure from the accumulated effects of corrosion caused by sample spillage. A failure produces a number of rotor fragments each of which carries a portion of the kinetic energy of the rotor. A containment system is provided in the centrifuge instrument in order to contain the resultant rotor fragments within the confines of the instrument, thus avoiding damage to people and/or property.

The size of the fragments usually depends upon the cause of the rotor failure. In a rotor failure caused by corrosion, for example, the fragments are relatively small, because the region of the rotor affected by corrosion is the sample receiving cavity near the rotor periphery. Rotor failure caused by fatigue or overspeed may be more severe.

The most severe form of rotor failure is a so-called "bi-hub" failure, in which the rotor breaks into two relatively massive fragments. The origin of the failure in a bi-hub failure is usually in the vicinity of the rotor mounting recess. In such a failure, although the containment system is designed to contain the fragments within the instrument, the impact of the fragments may cause movement of the instrument in the laboratory.

Various forms of mechanical arrangements are known which minimize the possibility of rotor failure due to overspeed. One class of overspeed protection arrangement includes a frangible member which fractures when an overspeed condition is imminent to mechanically disconnect the rotor from its source of motive energy. U.S. Pat. No. 3,990,633 (Stahl), U.S. Pat. No. 4,568,325 (Cheng et al.), U.S. Pat. No. 4,753,630 (Romanauskas), U.S. Pat. No. 4,753,631 (Romanauskas), the latter two patents being assigned to the assignee of the present invention) are representative of this class of overspeed protection arrangement. Another overspeed protection arrangement generally of this form includes a frangible member which fractures when an overspeed condition is imminent to electrically disconnect the rotor from its source of motive energy. U.S. Pat. No. 3,101,322 (Stallman) is representative of this form of arrangement.

Another known overspeed protection arrangement also uses a frangible element on the rotor which fractures when rotor speed reaches a predetermined value. The fragment so produced causes the rotor to be braked by increasing windage within the chamber in which the rotor is carried or by mechanical friction with the surrounding structure, thereby slowing rotor speed. Representative of this class of overspeed protection arrangement are U.S. Pat. No. 4,693,702 (Carson et al., assigned to the assignee of the present invention), U.S. Pat. No. 4,132,130 (Schneider), U.S. Pat. No. 4,509,896 (Linsker), and U.S. Pat. No. 4,507,047 (Coons).

Other arrangements are known which minimize the possibility of rotor failure due to fatigue of the material. One form of such a rotor protection arrangement limits the stress produced in the vicinity of the mounting of the rotor to the shaft. U.S. Pat. No. 4,822,330 (Penhasi) is believed exemplary of this class of device. German Patent 3,806,284 (Hirsch) discloses a centrifuge rotor having portions of the undersurface removed to reduce stress in the rotor.

Another alternative to control of the effects of rotor failure is to design a rotating apparatus, as a flywheel, to exhibit predetermined areas of vulnerability of rupture. The area of vulnerability may be defined by regions of weaker material or by stress risers in the material of the flywheel. Thus, in the event of an overspeed, failure will most likely occur in the area of vulnerability, producing a fragment having a predictable mass. U.S. Pat. No. 3,662,619 (Seeliger) and U.S. Pat. No. 4,111,067 (Hodson) are believed exemplary of this class of device.

SUMMARY OF THE INVENTION

The present invention relates to a centrifuge rotor having a body with an undersurface, portions of which are removed to define a predetermined number of bosses. Each boss has a sample receiving cavity therein. In accordance with this invention a relatively thin skirt portion is left remaining between at least one adjacent pair of bosses. The skirt portion so defined has a localized region thereon which exhibits a stress therein that is greater than the stress present in any other portion of the rotor when the rotor is operating at the predetermined operating speed. Thus, over operation time, the probability that rotor failure will occur only in the localized region of the skirt is enhanced.

The localized region of the skirt portion may be further provided with a weight disposed on either the inside or the outside surface thereof. The weight may be separate from or formed integrally with the skirt. Additionally or alternatively, the skirt may have a stress therein. In this event the stress within the riser is greater than the stress present in any other portion of the rotor when the rotor is operating at the predetermined operating speed. The stress riser may take the form of a hole, a notch or a groove.

BRIEF DESCRIPTION OF THE DRAWINGS

The invention will be more fully understood from the following detailed description thereof, taken in connection with the accompanying drawings, in which.

DETAILED DESCRIPTION OF THE INVENTION

Figure 1:
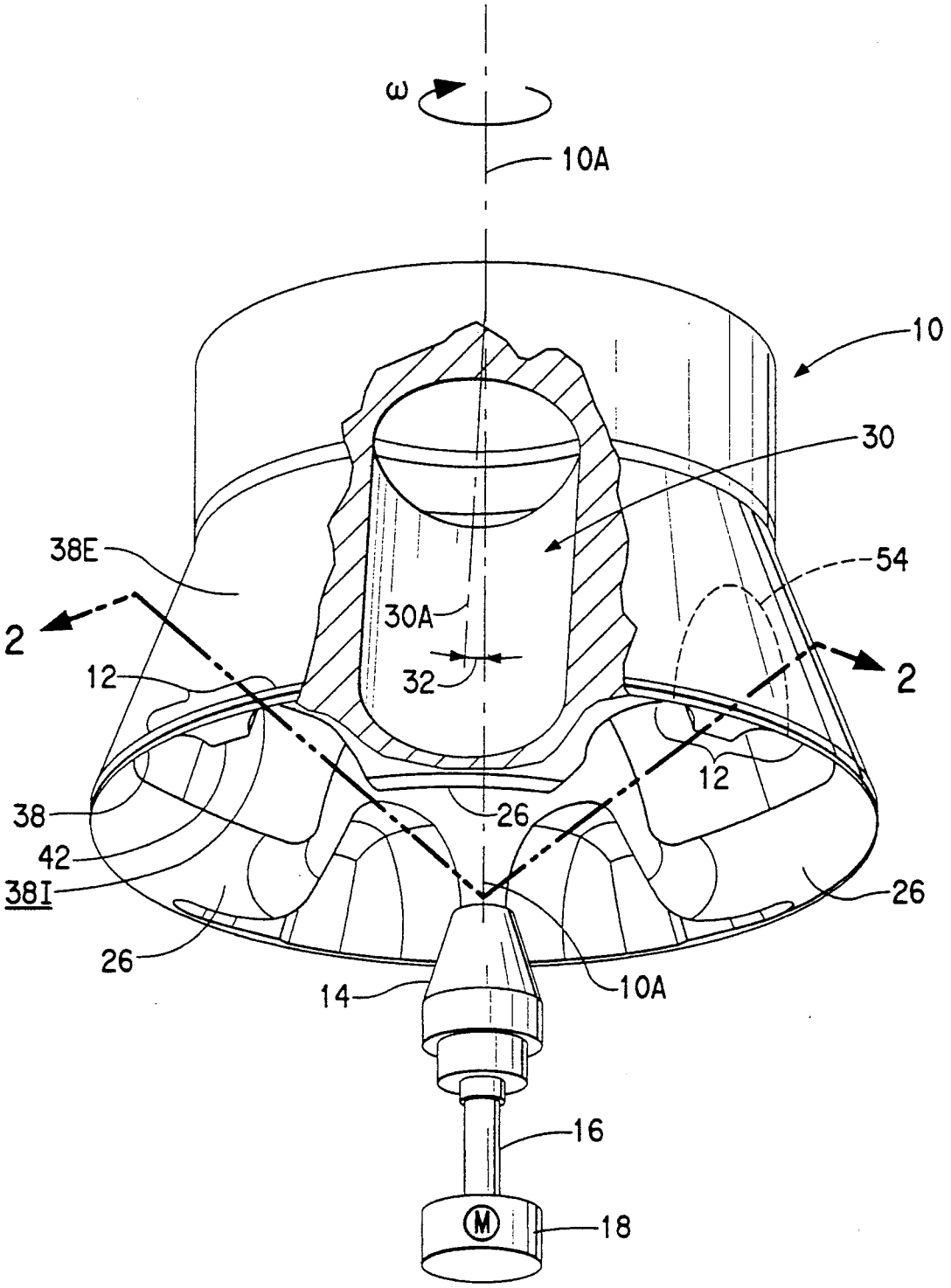
FIG. 1 is a perspective view of a centrifuge rotor in accordance with the present invention, with a portion of the rotor broken away to illustrate a sample receiving cavity within the rotor.

Throughout the following detailed description, similar reference numerals refer to similar elements in all Figures of the drawings.

Figure 2:
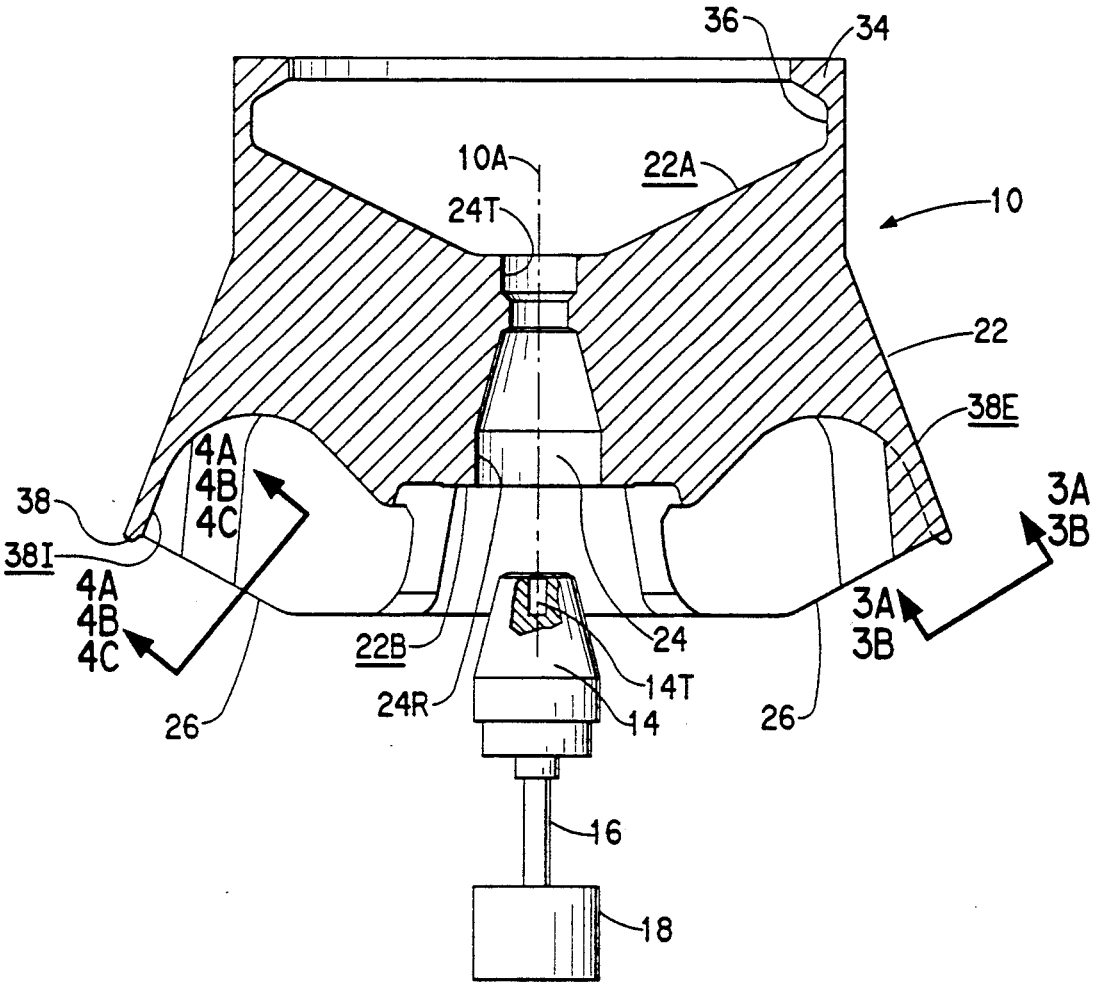
FIG. 2 is a sectional view taken along section lines 2—2 in FIG. 1.

Best shown in FIGS. 1 and 2 is a centrifuge rotor in accordance with the present invention, the rotor being generally indicated by the reference character 10. The rotor 10 has a localized region generally indicated by the reference character 12 (better seen in FIG. 1) that defines a predetermined failure site thereon. As will be developed, the localized region 12 exhibits a stress therein that is greater than the stress present in any other portion of the rotor when the rotor is operating at the predetermined operating speed.

In accordance with the present invention the stress level in the localized region 12 must be at least a level at which one would be reasonably confident that a failure will occur within the localized region 12. In the preferred instance, to assure this reasonable confidence, the stress in the localized region 12 is at least 1.5 to 2.0 times the stress elsewhere in the rotor. Reasonable confidence as to the occurrence of a failure in the localized may, in some instances, be assured with a lesser stress level.

As is understood by those skilled in the art the rotor 10 is mountable to a mounting member 14 disposed at the upper end of a shaft 16. The mounting member 14 may be provided with a threaded opening 14T therein. The shaft 16 is connected to a motive source 18 whereby the rotor 10 may be caused to rotate about an axis of rotation 10A at a predetermined operating rotational speed $\omega$.

The rotor 10 is a relatively massive member having a main body portion 22 (FIG. 2) defining an upper surface 22A and a undersurface 22B thereon. As seen in FIG. 2 a contoured opening generally indicated at 24 extends centrally and axially through the body 22 from the upper surface 22A to the undersurface 22B. The lower portion 24R of the opening 24 defines a recess configured to closely accept the mounting member 14 whereby the rotor 10 may be mounted to the shaft 16. The upper portion 24T of the opening 24 is sized to closely accept a threaded adapter assembly (not shown). The threaded adapter assembly includes a bolt that engages the threaded opening 14T in the mounting member 14 so that the rotor 10 may be secured thereto.

Portions of the undersurface 22B of the body 22 are removed thereby to define a predetermined number of depending bosses 26.

The rotor body 22 has a plurality of sample receiving cavities 30 formed therein (FIG. 1). Each cavity 30 is located in the body at a position that opens on the upper surface 22A of the body 22 and extends a predetermined distance into a boss 26. The cavity 30 has an axis 30A extending therethrough. The axis 30A may be inclined at a predetermined angle 32 with respect to the axis of rotation 10A of the rotor 10. In the case of a fixed angle rotor as is illustrated in FIGS. 1 and 2, the angle 32 may take any value from zero to about fifty five degrees. In FIG. 1 a portion of the rotor 10 is removed to illustrate the cavity 30 in one of the bosses 26. Each cavity 30 is sized to accept a container (not shown) carrying a liquid sample therein. If desired, a lip 34 may extend circumferentially about the upper surface 22A of the body 22. A fluid containment annulus 36 is formed in the lip 34.

The energy of a rotor before the failure of a portion thereof is defined as $$0.5(I\cdot\omega^2) \quad (1)$$

where

I is the mass moment of inertia of the rotor 10 about the axis of rotation 10A, and $\omega$ is the operating rotational speed of the rotor.

When a rotating body such as a rotor fails the energy before failure is resolved into two components: a rotational energy component and a translational energy component.

The rotational energy component of each rotor fragment is given by Equation (1), with I representing in this case the mass moment of inertia of the rotor fragment about its axis of rotation. The rotational energy component of each rotor fragment is mainly dissipated through friction generated as the fragment rotates against the containment walls and does not cause deformation of the containment system or movement of the centrifuge instrument.

The translational energy component of each rotor fragment is given by $$0.5M\cdot(R\cdot\omega)^2 \quad (2)$$

where

M is the mass of the rotor fragment,

R is the radial distance between the axis of rotation of the rotor before failure and the center of gravity of the fragment after failure, and $\omega$ is the operating rotational speed of the rotor.

The translational component of the rotor fragment causes deformation of the containment system and movement of the centrifuge instrument.

In order to minimize the translational energy of a rotor fragment produced by a rotor failure, in a rotor 10 in accordance with the present invention the site of highest probable rotor failure is located on a portion of the rotor that would produce small rotor fragments. To this end, the localized region 12 that defines the predetermined failure site thereon is located on or near to the periphery of the rotor 10. Since the localized region 12 exhibits a stress therein that is greater than the stress present in any other portion of the rotor when the rotor is operating at the predetermined operating speed, over operation time, the probability is enhanced that rotor failure will occur only in the localized region of the skirt. Since the mass of a fragment produced by a failure in the localized region is relatively small as compared to the remaining mass of the rotor, the translational energy component of the fragment is low as compared to total rotor energy. Moreover, since the remainder of the rotor undergoes only a small shift in center of gravity due to failure, the term R in the exponential quantity of Equation (2) is minimized. By keeping most of the original rotor energy in the form of rotational energy, containment energy deformation and instrument movement is minimized.

The localized region 12 may be defined in a variety of ways, all of which lie within the contemplation of the present invention.

As seen in FIGS. 1 and 2, in its simplest form the localized region 12 may be realized by leaving, during the removal of material from the undersurface 22A of the rotor body 12, a relatively thin, generally circumferentially extending skirt portions 38 between at least one adjacent pair of bosses 26. Preferably, a skirt 38 is defined between each of the bosses 26 formed on the rotor 10. The presence of the skirt portion 38 between adjacent bosses 26 creates in each skirt 38 a stress that is greater than the stress present in any other portion of the rotor when the rotor is operating at the predetermined operating speed. The situs of such increased stress is the vicinity of the junction between the skirt 38 and each associated boss 26. Rotor failure is thus more likely to occur here.

Figure 3A:
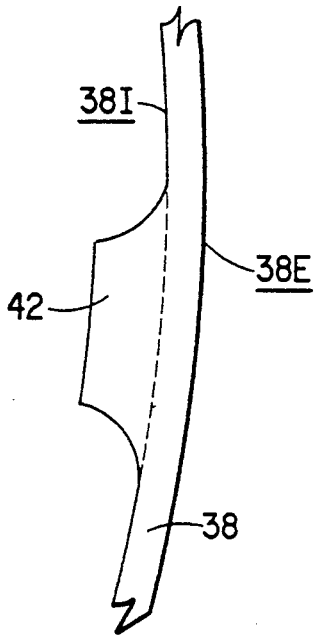
FIGS. 3A and 3B are bottom views taken along view lines 3A—3A, 3B—3B in FIG. 2 respectively illustrating an embodiment of the invention in which the skirt portion is provided with a weight disposed on the inside or on the outside surface thereof.
Figure 3B:
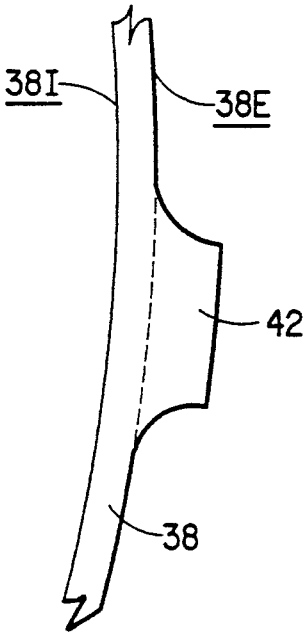

If desired, each skirt portion 38 may be additionally provided with a weight 42. The weight 42 may be disposed either on the inside surface 38I of the skirt 38 (FIG. 3A) or on the outside surface 38E thereof the skirt 38 (FIG. 3B). The disposition of the weight on the inside surface may be preferred, in order to minimize windage losses. The weight 42 may be separate from or integrally formed with the skirt 38. The weight 42 increases the payload carried by the skirt 38, thereby increasing the stress therein. If separate from the skirt the weight 42 may be attached thereto by any suitable joining expedient, such as an adhesive. It should be noted that in some cases a weight may be disposed on both the inside and outside surfaces, either at the same or at different circumferential locations.

Figure 4A:
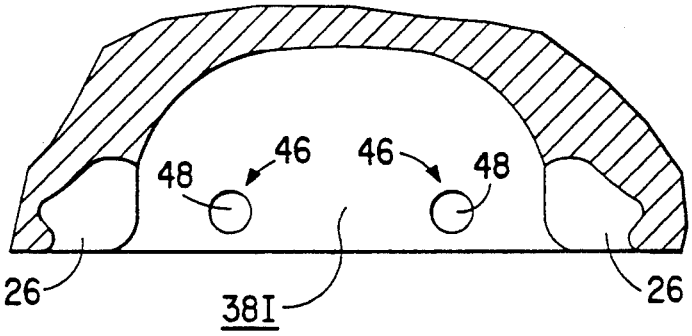
FIG. 4A through 4C are elevational views taken along view lines 4A—4A, 4B—4B and 4C—4C in FIG. 2 illustrating additional or alternate embodiments of the invention in which the skirt portion is provided with a stress riser.
Figure 4B:
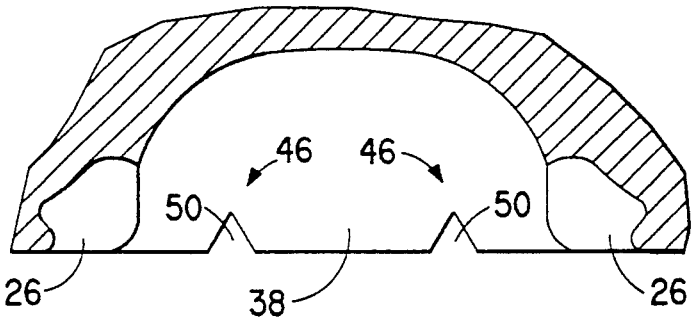
Figure 4C:
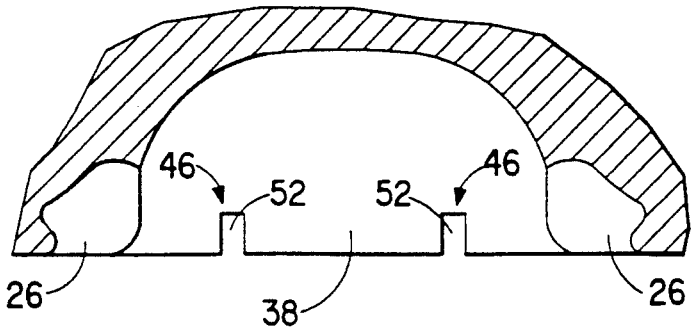

Additionally or alternatively to the weight 42, the skirt 38 may have at least one stress riser 46 formed therein. The stress riser 46 may take the form of either a through hole or a blind hole 48 (FIG. 4A), a notch 50 (FIG. 4A), or a groove 52 (FIG. 4C). Preferably, stress risers 46 (of any illustrated form) are used in associated pairs, as shown. When stress riser(s) 46 are employed it is the portion of the skirt 38 in the vicinity of the riser(s) 46 that exhibits a stress that is greater than the stress present in any other portion of the rotor when the rotor is operating at the predetermined operating speed.

A rotor 10 in accordance with the present invention as hereinabove described may be fabricated from any suitable typical rotor materials, such as aluminum or titanium. The rotor may be formed by any suitable manufacturing technique, such as forging, casting, or machining.

Owing to the structure of the rotor 10 as defined above, the localized region 12 is, in use, exposed to a stress that is relatively greater than the stress present in any other portion of the rotor when the rotor is operating at the predetermined operating speed. Thus, over time, failure of the rotor due to fatigue is more likely to occur in the localized region 12 on the periphery of the rotor 10, producing a small, less massive fragment. A rendering of a typical fragment is illustrated diagrammatically at reference character 54 in FIG. 1.

Those skilled in the art, having the benefit of the teachings of the present invention as hereinabove set forth may effect numerous modifications thereto. For example, although the invention is illustrated in the context of a fixed angle rotor it should be understood that the present invention may also be used with a swinging bucket rotor or a zonal rotor. In the case of a swinging bucket rotor the undersurface thereof would include bosses 26, with each boss 26 having a bucket receiving cavity therein. The skirt 38 would extend between the at least one pair of adjacent bosses. In the case of zonal rotor, the bosses 26 may be omitted, with the skirt 38 depending directly from the under surface of the zonal rotor. It should be understood that these and other such modifications lie within the contemplation of the present invention, as defined by the appended claims.

What is claimed is:

1. A centrifuge rotor operable to rotate about an axis of rotation at a predetermined operating speed, the rotor having a body with an undersurface, a relatively thin skirt portion disposed on the undersurface, the skirt portion having defined thereon a localized region which exhibits a stress therein that is greater than the stress present in any other portion of the rotor when the rotor is operating at the predetermined operating speed, so that, over operation time, the probability that rotor failure will occur only in the localized region of the skirt is enhanced.

2. The centrifuge rotor of claim 1 wherein portions of the undersurface of the body are removed to define a predetermined number of bosses, the relatively thin skirt portion being defined between at least one pair of adjacent bosses.

3. The centrifuge rotor of claim 2 wherein the skirt has a weight is disposed thereon.

4. The centrifuge rotor of claim 1 wherein the skirt has a weight is disposed thereon.

5. The centrifuge rotor of claim 2 wherein the skirt has a stress riser therein, the stress riser defining the localized region on the skirt which exhibits a stress therein that is greater than the stress present in any other portion of the rotor when the rotor is operating at the predetermined operating speed.

6. The centrifuge rotor of claim 1 wherein the skirt has a stress riser therein, the stress riser defining the localized region on the skirt which exhibits a stress therein that is greater than the stress present in any other portion of the rotor when the rotor is operating at the predetermined operating speed.

7. A centrifuge rotor operable to rotate about an axis of rotation at a predetermined operating speed, the rotor having a body with an undersurface, portions of the undersurface of the body being removed to define a predetermined number of bosses, a relatively thin skirt portion remaining between at least one pair of adjacent bosses, the skirt portion having defined thereon a localized region which exhibits a stress therein that is greater than the stress present in any other portion of the rotor when the rotor is operating at the predetermined operating speed, so that, over operation time, the probability that rotor failure will occur only in the localized region of the skirt is enhanced.

8. The centrifuge rotor of claim 7 wherein the skirt has a weight thereon.

9. The centrifuge rotor of claim 8 wherein the skirt has an inside surface thereon, and wherein the weight is disposed on the inside surface of the skirt.

10. The centrifuge rotor of claim 8 wherein the skirt has an outside surface thereon, and wherein the weight is disposed on the outside surface of the skirt.

11. The centrifuge rotor of claim 8 wherein the weight is integrally formed the skirt.

12. The centrifuge rotor of claim 8 wherein the weight is separate from and mounted on the skirt.

13. The centrifuge rotor of claim 7 wherein the skirt has a stress riser therein, the stress riser defining the localized region on the skirt which exhibits a stress therein that is greater than the stress present in any other portion of the rotor when the rotor is operating at the predetermined operating speed.

14. The centrifuge rotor of claim 13 wherein the stress riser is defined by at least one hole.

15. The centrifuge rotor of claim 13 wherein the stress riser is defined by at least one notch.

16. The centrifuge rotor of claim 13 wherein the stress riser is defined by at least one groove.

17. The centrifuge rotor of claim 8 wherein the skirt has a stress riser therein, the stress riser defining the localized region on the skirt which exhibits a stress therein that is greater than the stress present in any other portion of the rotor when the rotor is operating at the predetermined operating speed.

18. The centrifuge rotor of claim 17 wherein the stress riser is defined by at least one hole.

19. The centrifuge rotor of claim 17 wherein the stress riser is defined by at least one notch.

20. The centrifuge rotor of claim 17 wherein the stress riser is defined by at least one groove.

* * * * *